US005760320A

United States Patent [19]

Gooday

[11] Patent Number: 5,760,320

[45] Date of Patent: Jun. 2, 1998

[54] STRINGED INSTRUMENT

[75] Inventor: Mark A. Gooday, Maldon, Great Britain

[73] Assignee: Kaman Music Corporation, Bloomfield, Conn.

[21] Appl. No.: 612,454

[22] Filed: Mar. 6, 1996

[30] Foreign Application Priority Data

Mar. 7, 1995 [GB] United Kingdom ..... 9504498

[51] Int. Cl.[6] ..... G10D 3/14

[52] U.S. Cl. ..... 84/304; 84/306

[58] Field of Search ..... 84/304, 305, 306, 84/303

[56] References Cited

U.S. PATENT DOCUMENTS

| | | | |
|---|---|---|---|
| 1,993,647 | 3/1935 | Cerrone | 84/304 |
| 2,588,101 | 3/1952 | Finder | 84/291 |
| 4,078,468 | 3/1978 | Civitello | 84/274 |
| 4,576,080 | 3/1986 | Grerory | 84/267 |
| 5,113,737 | 5/1992 | McLellan et al. | 84/267 |

FOREIGN PATENT DOCUMENTS

| | | |
|---|---|---|
| 696064 | 9/1940 | Germany . |
| 747089 | 9/1944 | Germany . |
| Des. 1004034 | 6/1981 | United Kingdom . |
| Des. 1004035 | 6/1981 | United Kingdom . |
| Des. 2021271 | 8/1991 | United Kingdom . |
| 2247335 | 2/1992 | United Kingdom . |

*Primary Examiner*—Cassandra C. Spyrou
*Attorney, Agent, or Firm*—McCormick, Paulding & Huber

[57] ABSTRACT

A stringed instrument, such as a guitar, has a finger-board, a headstock located at one end of the finger-board, and a plurality of machine-heads mounted on the finger-board for adjusting the tension of the strings. Each machine-head has a rotatable winding peg for winding a respective string to be adjusted, and a rotatable adjusting handle coupled to the winding peg for rotating the peg. The axis of rotation of the adjusting handle is inclined rearwardly relative to the plane of the finger-board and is non-parallel to the axis of rotation of the winding peg. In addition, the axis of rotation of the adjusting handle is inclined at an acute angle relative to a perpendicular to the longitudinal axis of the instrument and generally toward the opposite end of the instrument, in order to facilitate the ability of a person playing the instrument to locate and adjust each machine-head.

11 Claims, 6 Drawing Sheets

STRINGED INSTRUMENT

FIELD OF THE INVENTION

The present invention relates to a stringed instrument and in particular to a stringed instrument comprising at least one machine-head for adjusting the tension of a string of the instrument.

BACKGROUND INFORMATION

Typically, a guitar has a sound box (i.e. a housing enclosing a resonant cavity), which is overlaid by one or more strings or courses. Fixed to the sound box is a longitudinal member having a planar front surface forming a finger-board. At the distal end of the longitudinal member, a headstock is formed to which are fixed one or more "tuning machines" or " machine-heads"for adjusting the respective tensions of the one or more strings. It will be appreciated that in an electric guitar, the sound box has little or no resonant function and is not usually hollow being usually just a solid resonant body. Nevertheless, for the purposes of this patent specification, the term sound box will be understood to include the component of an electric guitar which resembles the sound box of an acoustic guitar.

The design of such a guitar headstock has remained unchanged for many years. The original construction was derived from the Spanish guitar, from guiterras and five course stringed instruments. Modifications were made towards the end of the nineteenth century as more modern production techniques and the effects of consumer demand began to impinge on the world of guitar manufacture.

The known headstock has thus evolved into a planar headstock which is co-planar with the finger-board, and which has machine-head adjusting handles having axes of rotation which lie in a plane parallel to that of the finger-board and which are perpendicular to the longitudinal axis of the instrument.

Examples of this type of headstock are known from the three-a-side headstock which has three machine-heads mounted on opposite sides of a planar headstock. An alternative to this is the direct-string-pull one-sided type of headstock in which all of the machine-heads are mounted on one side of the headstock.

It is an object of the present invention to provide an improved guitar headstock.

SUMMARY OF THE INVENTION

According to a first aspect of the invention, a stringed instrument comprises a finger-board and at least one machine-head for adjusting the tension of a string of the instrument, the machine-head having a rotatable winding peg for the winding of a string to be adjusted, and a rotatable adjusting handle, the axis of rotation of the handle being inclined rearwardly relative to the plane of the finger-board and said axis being non-parallel to the axis of rotation of the winding peg.

In this way, the handle of the machine-head in use, falls naturally to the hand of a player and no longer requires the player to undergo uncomfortable and unnatural flexion of the wrist or to watch the movement of his or her hand in order to find the adjusting handle.

The rearward inclination may be achieved in several ways. A conventional perpendicular machine-head (having an adjusting-handle axis of rotation perpendicular to the winding-peg axis of rotation) may be mounted in an inclined hole formed in a planar headstock. Alternatively, a machine-head having a post or winding peg having a rotation axis which is non-perpendicular to the adjusting-handle axis may be mounted in a non-inclined hole in a planar headstock. As a further alternative, the headstock itself may have inclined portions which are inclined rearwardly relative to the plane of the finger-board, the machine-head being mounted in the inclined portion.

It will be understood that the alternatives described above may be used in any combination provided the overall effect is that the axis of rotation of the adjusting handle is inclined rearwardly relative to the plane of the finger-board.

According to a second aspect of the invention, a stringed instrument comprises a sound box and at least one machine-head for adjusting the tension of a string of the instrument, the machine-head having a rotatable adjusting handle, the axis of rotation of the handle being inclined towards the sound box (or generally toward the opposite end of the instrument) relative to a perpendicular to the longitudinal axis of the instrument.

This arrangement also improves the operation of the machine-head in use in a similar manner to that of the first aspect. This is at least because the axis of rotation of the adjusting handle is in effect "pointing" considerably more towards the player than in the prior art construction.

It will, of course, be understood that the features of the two aspects of the invention may be combined.

As a further enhancement, the entire headstock may be inclined rearwardly relative to the plane of the finger-board. Preferably the change in inclination between the finger-board and the headstock occurs generally about a line perpendicular to the longitudinal axis of the instrument (i.e. parallel to a fret of the instrument).

According to a further aspect of the invention, a machine-head for a stringed instrument comprises a rotatable adjusting handle and a rotatable winding peg, the axis of rotation of the handle being inclined relative to the axis of rotation of the winding peg at an angle less than 180° but greater than 90°, the machine-head being operable such that rotation of the handle causes rotation of the winding peg.

BRIEF DESCRIPTION OF THE DRAWINGS

The invention will now be described by way of example with reference to the drawings in which.

DETAILED DESCRIPTION OF THE PREFERRED EMBODIMENTS

Figures 1A, 1B:
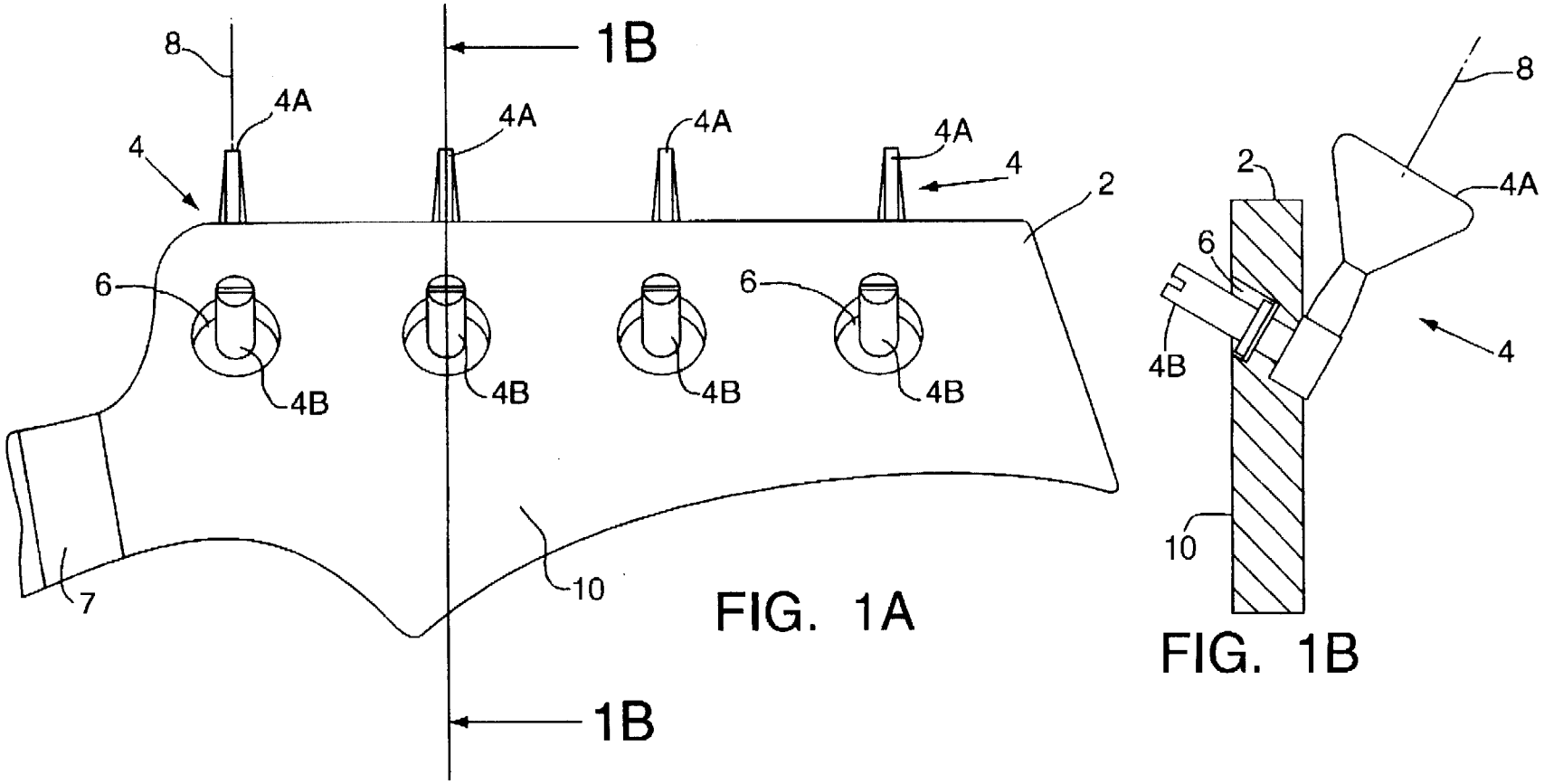
FIG. 1A is a front elevation of a headstock having an inclined hole in accordance with the invention.
FIG. 1B is a cross-section on line A—A of FIG. 1A.

With reference to FIGS. 1A and 1B, a planar or "plank" headstock 2 is shown. Four conventional perpendicular machine-heads 4 having adjusting handles 4A and winding pegs 4B are mounted in inclined holes 6 formed in the headstock 2.

Since the holes 6 are inclined, the axis of rotation 8 of each of the handles 4A, is also inclined. The inclination is rearward in relation to the finger-board 7 (or the surface 10 of the headstock 2).

Figure 2B:
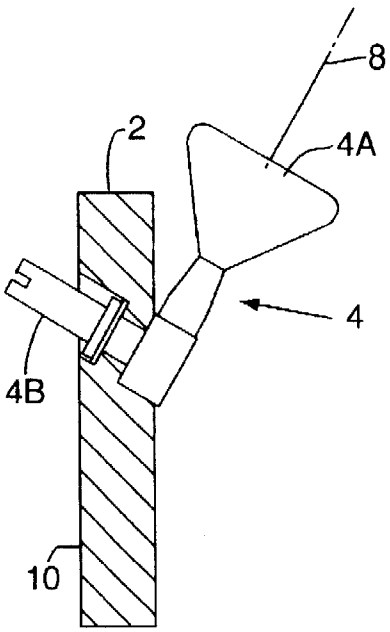
FIG. 2B is a cross-section on line A—A of FIG. 2A.
Figure 2A:
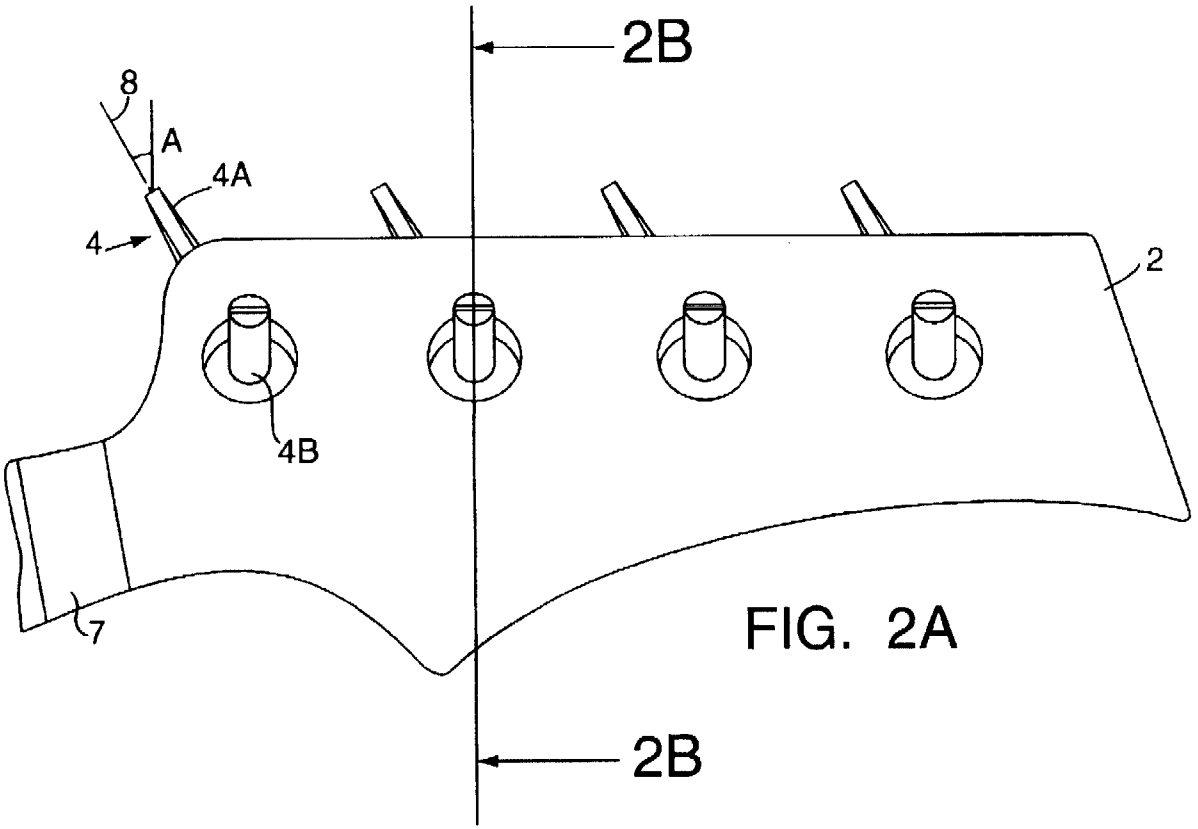
FIG. 2A is a front elevation of a headstock having an inclined hole and having a handle axis inclined towards the sound box (or generally toward an opposite end of the guitar) in accordance with the invention.

With reference to FIGS. 2A and 2B, a similar construction is shown except that the axis 8 (with particular reference to FIG. 2A) is inclined at an acute angle A to a perpendicular to the longitudinal axis of the guitar. In the embodiment of the present invention illustrated in FIG. 2A, the angle A is approximately 30°.

Figure 3B:
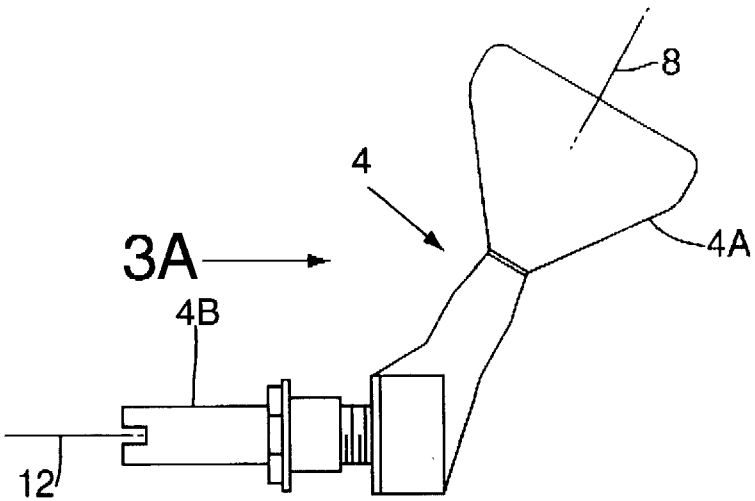
FIG. 3B is a side elevation of the machine-head of FIG. 3A.
Figure 3A:
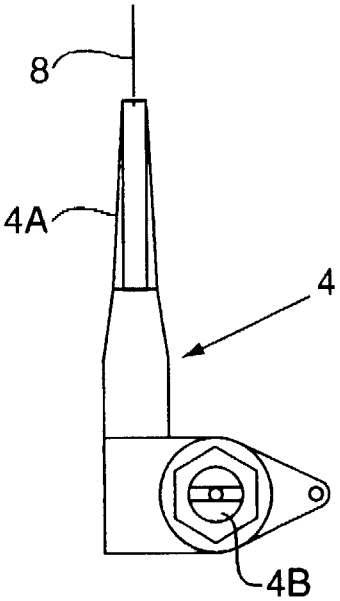
FIG. 3A is a front elevation (in the direction of arrow 3A in FIG. 3B) of a machine-head having a non-perpendicular adjusting handle axis in accordance with the invention.

With reference to FIGS. 3A and 3B, a rearward inclination of the adjusting handle 4A may be achieved by using a machine-head 4 whose axis 8 is not perpendicular to the axis 12 of rotation of the winding peg 4B. Such a machine-head may be used in a planar headstock with a non-inclined hole still to achieve an overall rearward inclination of the axis 8.

Figure 4B:
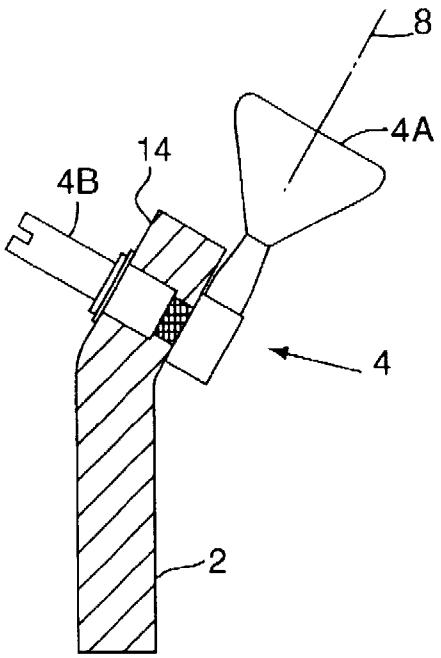
FIG. 4B is a cross-section on line A—A of FIG. 4A.
Figure 4A:
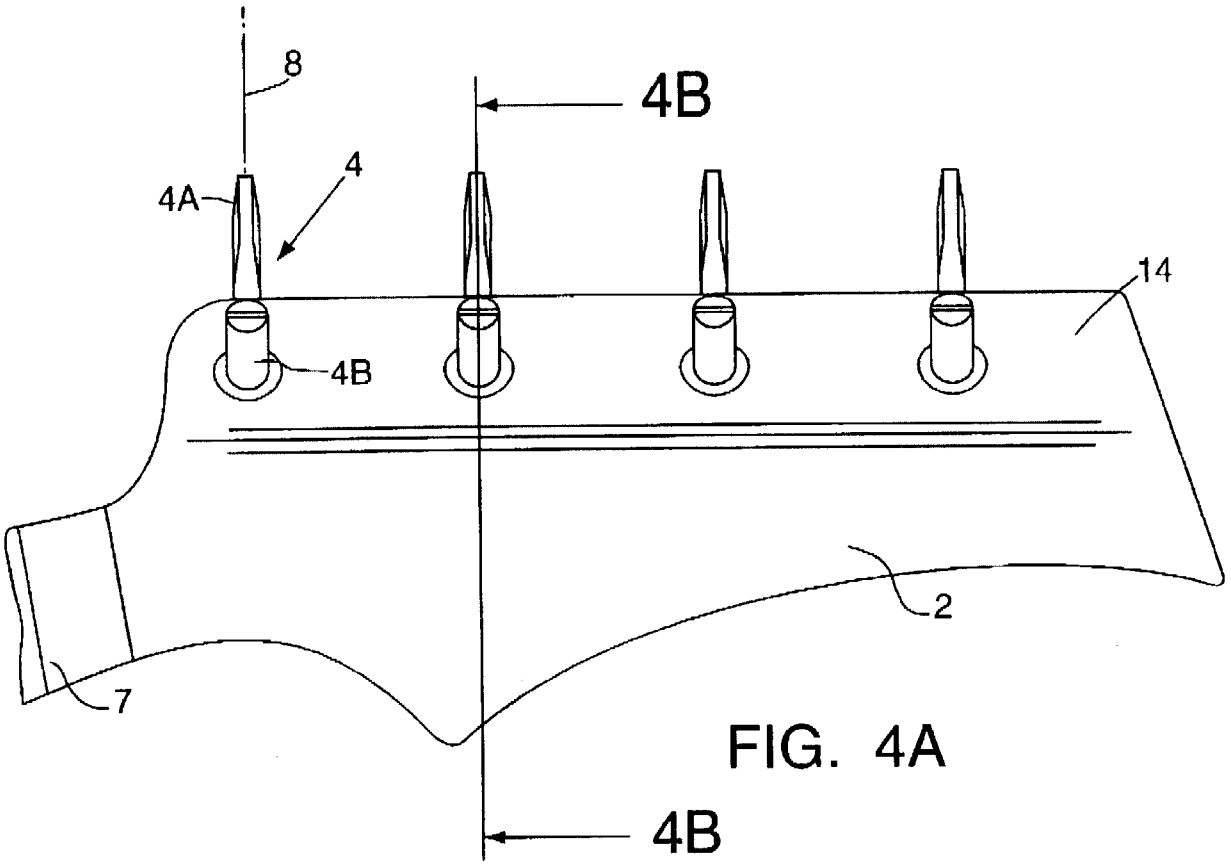
FIG. 4A is a front elevation of a headstock having a rearwardly inclined portion.

With reference to FIGS. 4A and 4B, a rearward inclination of the axis 8 may also be achieved by forming a rearwardly inclined portion 14 in the headstock 2. In this way, a conventional perpendicular machine-head 4 may be used in a non-inclined hole and yet still achieve a rearward inclination of the axis 8.

Figure 5B:
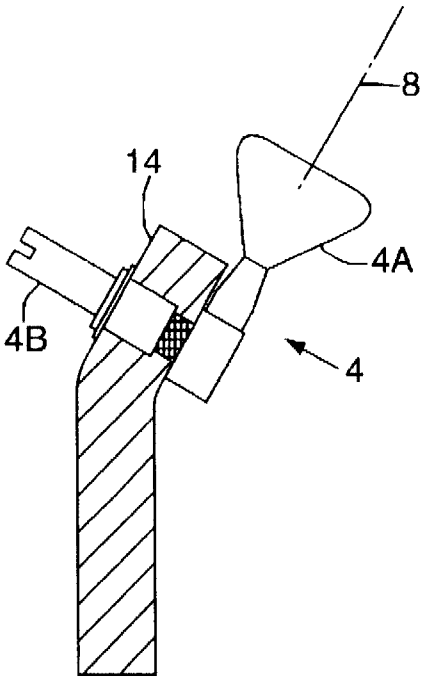
FIG. 5B is a cross-section on line A—A of FIG. 5A.
Figure 5A:
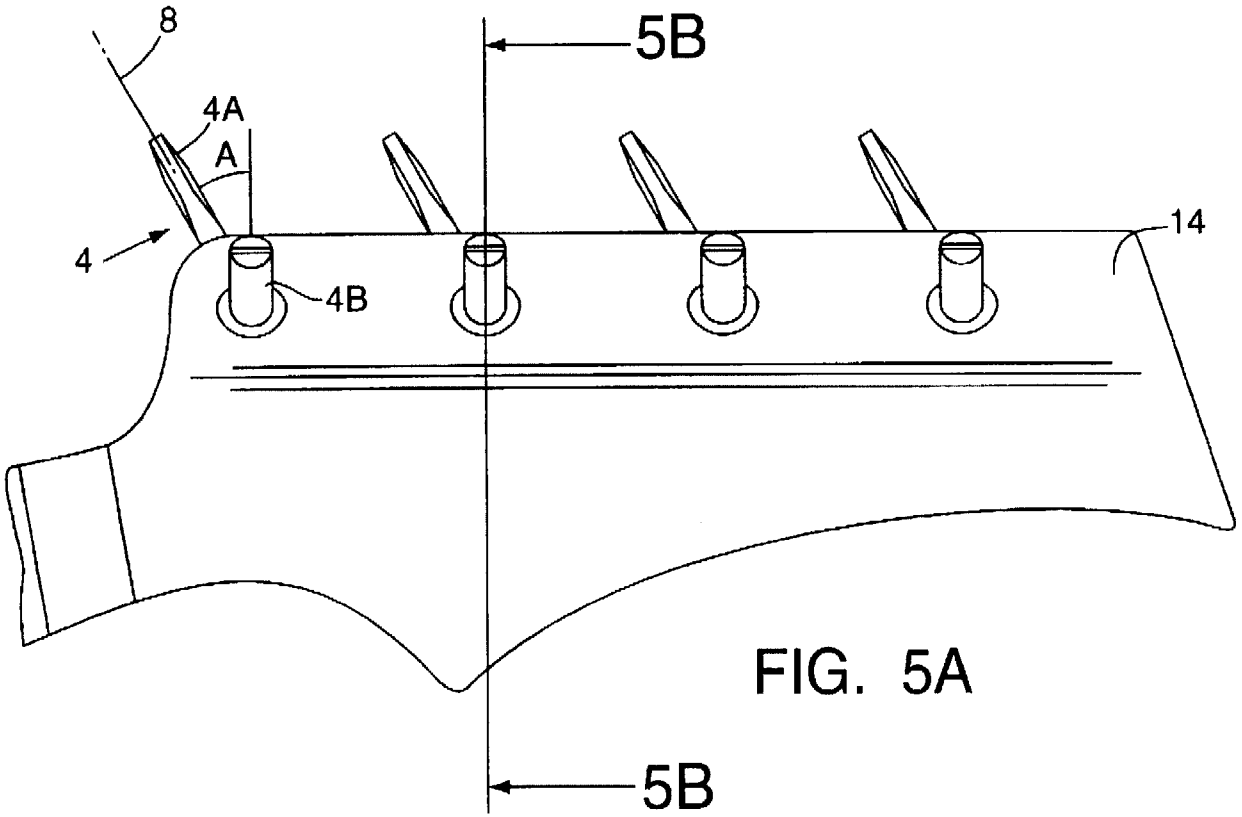
FIG. 5A is a front elevation of a headstock having a rearwardly inclined portion and having a machine-head adjusting handle axis inclined towards the sound box of a guitar (or generally toward an opposite end of the guitar)

With reference to FIGS. 5A and 5B, a similar construction to that of FIGS. 4A and 4B is shown. However, in this embodiment, the axis 8 is inclined towards the sound box (or generally toward an opposite end of the guitar), at an angle of 30° to a perpendicular to the longitudinal axis of the instrument.

Figure 6B:
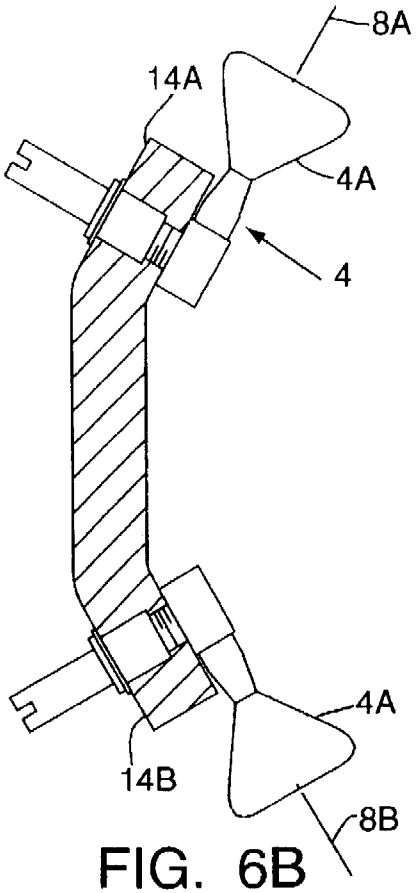
FIG. 6B is a cross-section on line A—A of FIG. 6A.
Figure 6A:
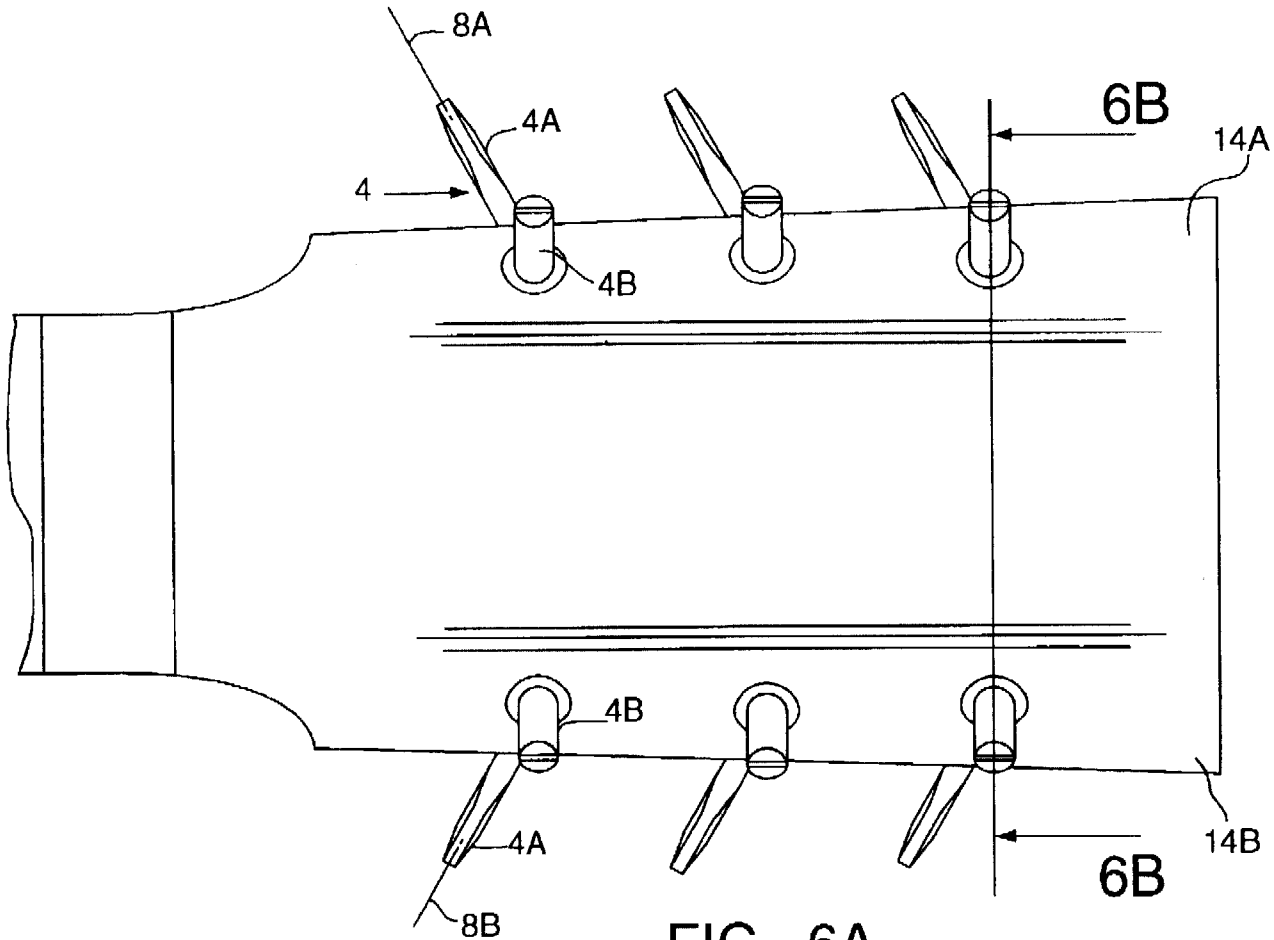
FIG. 6A is a front elevation of a headstock having two rearwardly inclined portions and having machine-head adjusting handle axes inclined towards the sound box of a guitar.

FIGS. 6A and 6B show a similar construction to that of FIGS. 5A and 5B except that two rearwardly inclined portions 14A, 14B are formed in the headstock thereby producing two rearwardly inclined axes 8A, 8B of rotation of the adjusting handles 4A.

As will be recognized by those skilled in the pertinent art, numerous changes may be made to these and other embodiments of the present invention without departing from its scope as defined in the appended claims. For example, although the rearward angle of inclination of the axis of rotation of the adjusting handle relative to the plane of the finger board is shown in the drawings of this application to be approximately 30°, this angle may be adjusted as desired depending upon the particular size and/or construction of an instrument, and/or the desire of a particular user. In addition, although the preferred embodiments illustrate the invention incorporated within a guitar, it may equally be employed in other types of stringed instruments, as well as many different types of guitars. Accordingly, the detailed description of preferred embodiments herein is to be taken in an illustrative as opposed to a limiting sense.

What is claimed is:

1. A stringed instrument comprising a finger-board including a front face defined at least in part by a first plane and a plurality of frets thereon, and a plurality of machine-heads, each for adjusting the tension of a string of the instrument, wherein each machine-head includes a rotatable winding peg defining an axis of rotation for winding the string to be adjusted, and a rotatable adjusting handle coupled to the winding peg and defining an axis of rotation for rotating the handle, and wherein the axis of rotation of the adjusting handle is substantially located within both a second plane inclined rearwardly at an acute angle relative to the first plane of the finger-board and a third plane orthogonal to the first plane of the finger-board, and wherein the third plane intersects the first plane along a line non-parallel to a longitudinal axis of the finger-board.

2. A stringed instrument as defined in claim 1, further comprising a headstock located at one end of the finger-board, wherein at least one of said plurality of machine-heads is mounted within a hole formed in the headstock and defining an axis located within a plane oriented at an acute angle relative to a normal to the first plane of the finger-board.

3. A stringed instrument as defined in claim 1, further comprising a headstock located at one end of the finger-board, wherein at least one of said plurality of machine-heads is mounted on a surface of the headstock formed approximately within a plane inclined rearwardly at an acute angle relative to the first plane of the finger-board.

4. A stringed instrument as defined in claim 4, wherein the mounting surface of the headstock is inclined about a line perpendicular to the longitudinal axis of the finger-board.

5. A stringed instrument as defined in claim 1, wherein the axis of rotation of an adjusting handle is oriented at an angle of between 90° and 180° relative to the axis of rotation of the corresponding winding peg.

6. A stringed instrument as defined in claim 1, wherein the axis of rotation of the adjusting handle is inclined at an angle of approximately 30° relative to a perpendicular to the longitudinal axis of the finger-board.

7. A stringed instrument as defined in claim 1, further comprising a headstock located at one end of the finger-board and the plurality of machine-heads mounted on opposite sides of the headstock relative to each other, wherein each machine-head is mounted on a respective surface of the headstock formed approximately within a plane inclined rearwardly at an acute angle relative to the first plane of the finger-board.

8. A stringed instrument as defined in claim 1, wherein the axis of rotation of at least one adjusting handle is inclined at an acute angle relative to a perpendicular to a longitudinal axis of the finger-board and generally toward an opposite end of the instrument.

9. A stringed instrument as defined in claim 1, wherein the axis of rotation of the adjusting handle is non-perpendicular to the axis of rotation of the winding peg and is inclined rearwardly relative to the first plane of the finger-board.

10. A stringed instrument as defined in claim 9, wherein said plurality of machine heads are spaced relative to each other along a line extending adjacent to at least one side edge of the fingerboard.

11. A stringed instrument as defined in claim 9, wherein the axis of rotation of the adjusting handle is non-perpendicular to the axis of rotation of the winding peg.

* * * * *